US005878900A

United States Patent [19]

Hansen

[11] Patent Number: 5,878,900

[45] Date of Patent: Mar. 9, 1999

[54] PLASTIC BOTTLE WITH TWO SEPARATION AREAS

[76] Inventor: Bernd Hansen, Heerstrasse 16, 74429 Sulzbach-Laufen, Germany

[21] Appl. No.: 594,790

[22] Filed: Jan. 31, 1996

[30] Foreign Application Priority Data

Mar. 9, 1995 [DE] Germany ..... 195 08 326.1

[51] Int. Cl.[6] ..... B65D 1/02; B65D 23/00; B65D 39/00

[52] U.S. Cl. ..... 215/50; 215/47; 215/48; 215/247; 215/251

[58] Field of Search ..... 215/47–50, 386, 215/247, 251; 604/415

[56] References Cited

U.S. PATENT DOCUMENTS

| | | | |
|---|---|---|---|
| 4,055,282 | 10/1977 | Komendowski | 215/47 X |
| 4,207,990 | 6/1980 | Weiler et al. | 215/47 X |
| 4,378,891 | 4/1983 | Fowles et al. | 215/48 |
| 4,463,862 | 8/1984 | Hansen | 215/50 |
| 4,526,279 | 7/1985 | Weiler et al. | 215/48 |
| 4,566,613 | 1/1986 | Anscomb | 215/48 X |
| 4,618,076 | 10/1986 | Silvenis | 215/386 X |
| 4,671,420 | 6/1987 | Marcus | 215/50 X |
| 4,821,897 | 4/1989 | Weiler | 215/48 |
| 4,901,873 | 2/1990 | Weiler | 215/48 |
| 5,054,267 | 10/1991 | Dundas | 215/47 X |
| 5,108,387 | 4/1992 | Falk et al. | 215/251 X |
| 5,595,314 | 1/1997 | Weiler | 215/251 X |

*Primary Examiner*—Sue A. Weaver
*Attorney, Agent, or Firm*—Roylance,Abrams,Berdo & Goodman, L.L.P.

[57] ABSTRACT

A plastic bottle includes a bottle body, a neck constructed on the bottle body and a head constructed on the neck. A separation area is provided between the head and the neck. On the neck and/or between the neck and the bottle body at least one additional separation area is provided.

18 Claims, 3 Drawing Sheets

PLASTIC BOTTLE WITH TWO SEPARATION AREAS

FIELD OF THE INVENTION

The present invention relates to a plastic bottle with one separation area between its head and neck and another separation area between or adjacent its neck and bottle body, as well as to a method for its manufacture.

BACKGROUND OF THE INVENTION

A bottle for medicinal liquids is disclosed in German Patent No. 30 33 821 A1. A neck is constructed on a bottle body, and a head constructed on the neck. The head closes off the bottle with a seal. The head can be screwed or twisted away from the neck by a toggle, such that the separation point provided between head and neck is opened and exposes a plug inserted in the neck. The plug can be pierced by a syringe or injector to remove the contents from the bottle. However, these techniques for removal of the contents does not suffice for all uses.

SUMMARY OF THE INVENTION

Objects of the invention are to provide an improved bottle which permits different techniques for removal of the bottle contents, and to provide a method for its manufacture.

The foregoing objects are basically obtained by a plastic bottle comprising a bottle body, a neck on the bottle body and a head on the neck. A first separation point or area is between the head and the neck. A second separation point or area is adjacent the neck and the bottle body.

The foregoing objects are also obtained by a method of manufacturing a plastic bottle comprising the steps of extruding a plastic parison into a blow or suction molding apparatus to form a plastic bottle having a bottle body, a neck on the bottle body and a head on the neck, forming a first separation area between the head and the neck, and forming a second separation area adjacent the neck and the bottle body.

Since at least one additional separation or point area is provided at the neck and/or between or adjacent the neck and bottle body, several possible techniques can be employed for removal of the preferably medicinal liquid from the bottle. Where the bottle has different interior diameters at the separation areas, the additional separation area can be configured to allow rapid removal of the liquid from the bottle, for instance by pouring it out. The bottle of the present invention can also have more than two separation areas.

In an advantageous manner, the separation areas are configured as predetermined breaking points having decreased wall thicknesses. German Patent No. 38 23 428 A1 discloses certain patterns or shapes of the bottle wall in the area of the separation points which are advantageous to maintain a clean hole edge during the breaking. The present invention is not limited to the construction of predetermined breaking points for separation areas. Opening could also be attained with a knife or the like at the separation areas.

If the bottle is to be opened manually, means for applying the required force manually for the separation are preferably provided near the respective separation areas. Such means could, for example, be a toggle or gripping depression. If at a separation area the bottle has so large an interior diameter that the force required for separation can no longer be applied directly with the operator's hand, the bottle can incorporate means for engaging a tool. Such means could, for instance, be a multi-faceted area or even a toggle.

When the liquid in the bottle is to be drawn out in a syringe, the bottle can be required to remain tightly mechanically and/or antiseptically sealed during and following the drawing out process. For this purpose a plug is preferably inserted in the neck and seals the neck. If the second separation area according to the present invention is provided between the part of the neck surrounding the plug and the bottle body, loosening or detachment at the second separation area removes the entire plug along with the part of the neck surrounding it, so that the liquid can be removed directly from the bottle body. If the second separation area is provided in the area of the plug itself, the plug can be removed and reinserted to close the bottle for subsequent waste disposal of the different materials or for dispensing of the residue of the bottle.

One advantageous method of manufacture of the plastic bottle according to the present invention is a blow molding method. The bottle is formed from one single piece of an extruded plastic hose or parison in several processing steps. Between these processing steps, the liquid is filled in and a plug is inserted. Instead of a blow molding method, a suction molding method can also be used.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
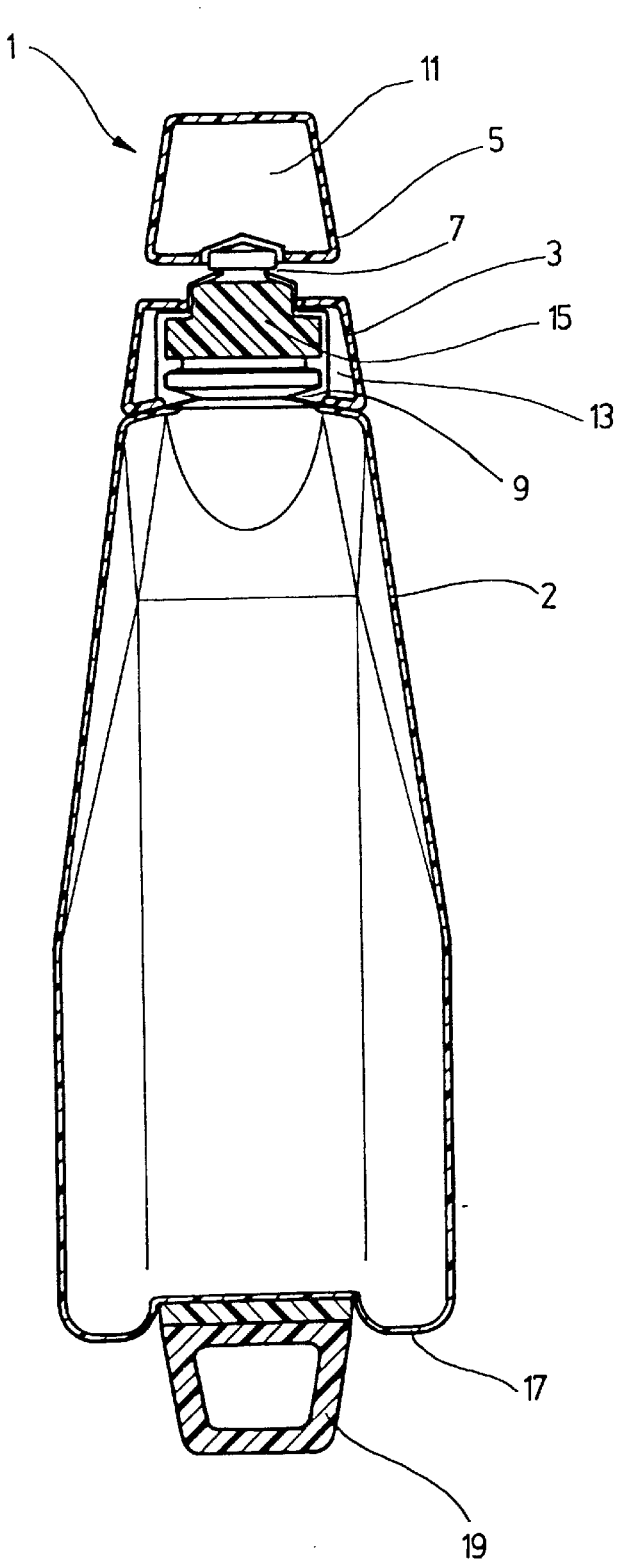
FIG. 1 is a front elevational view in section of a plastic bottle according to the present invention taken along line I—I of FIG. 2.
Figure 2:
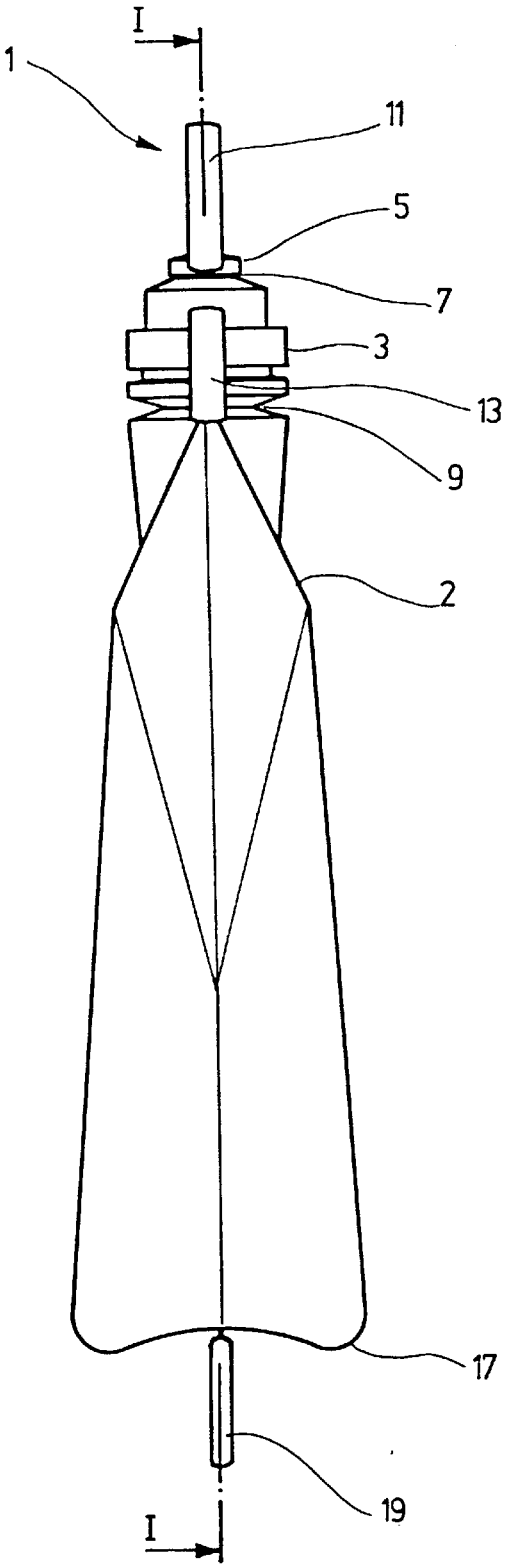
FIG. 2 is a side elevational view of the plastic bottle of FIG. 1.

A plastic bottle 1 has a bottle body 2 on which a neck 3 is constructed. On neck 3, in turn, a head 5 is constructed. The longitudinal alignment or axis of bottle 1 is defined by the arrangement of neck 3 on bottle body 2. The entire bottle 1 preferably comprises two mirror-image, identical longitudinal halves, which define bottle 1 along a symmetrical longitudinal plane or longitudinal plane of symmetry.

Bottle 1 has a separation point, line or area 7 between head 5 and neck 3. Separation point 7 lies in a separation plane perpendicular to the longitudinal axis of bottle 1 and its symmetrical plane. In this separation plane, the wall of bottle 1 has a circular design.

Adjacent neck 3 and bottle body 2 (i.e., in the transition from the bottle body to the neck, or in the neck between the neck-bottle body transition and separation area 7) another separation point, line or area 9 is provided. This additional separation point 9 also lies in a separation plane perpendicular to the longitudinal axis of bottle 1, and parallel to the separation plane of separation point 7. In separation point 9, the wall of bottle 1 is likewise of circular design. Relative to the bottle diameter, bottle 1 has a smaller interior diameter at separation point 7 than at separation point 9. In a modification of the exemplary embodiment, the bottle according to the invention could also incorporate separation points in separation planes which do not extend perpendicular to the longitudinal axis of the bottle.

Both separation points 7 and 9 are formed as predetermined breaking points with decreased wall thicknesses. Each is formed by the base of an annular groove having a wedge-like cross-sectional profile. The wall of bottle 1 extends toward each separation point from neck 3 and head 5, or from bottle body 2 and neck 3, and tapers conically toward the relevant separation point 7 or 9. By rotation of the parts to be separated relative to one another around an axis perpendicular to the relevant separation planes and/or by tipping, a break is formed along the selected separation point, i.e., separation point 7 or separation point 9.

Figure 3:
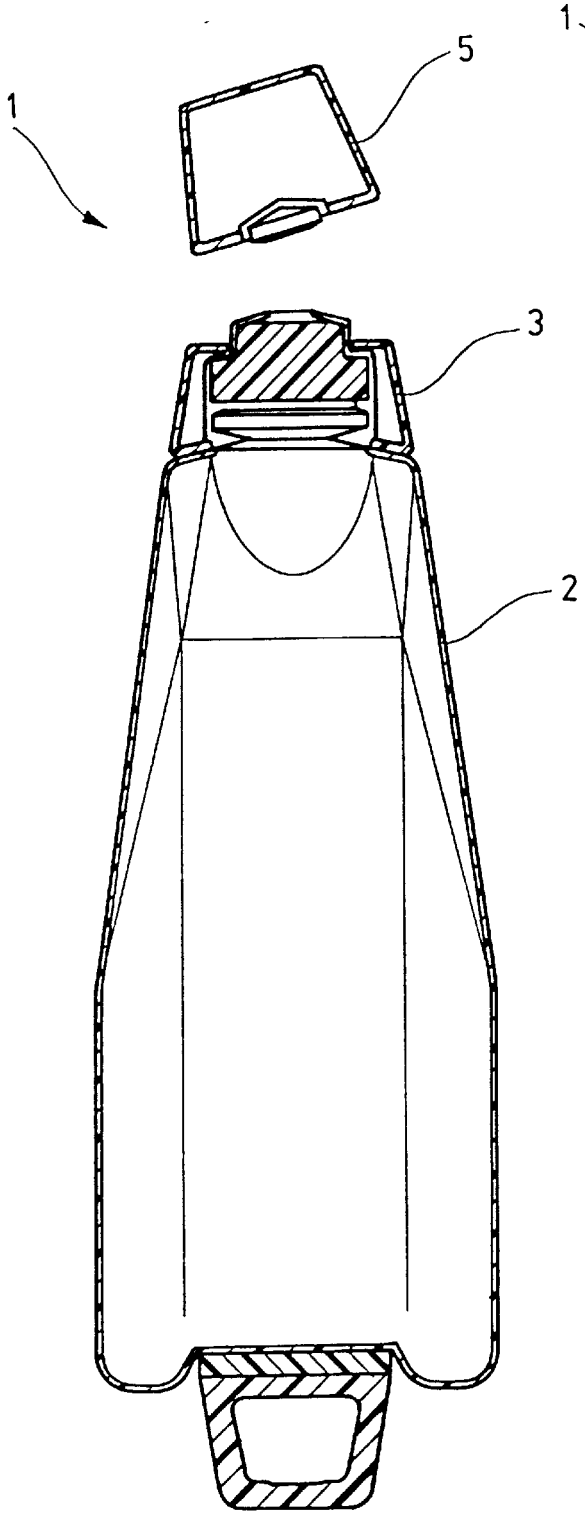
FIG. 3 is a front elevational view in section of the bottle of FIG. 1 with the head separated at the first separation area.

For the breaking of separation point 7, head 5 comprises a first toggle 11 and neck 3 comprises a second toggle 13. The breaking of separation point 7 then occurs by manual twisting and/or tipping of the two toggles 11 and 13 relative to one another. FIG. 3 shows bottle 1 with a broken separation point 7.

Figure 4:
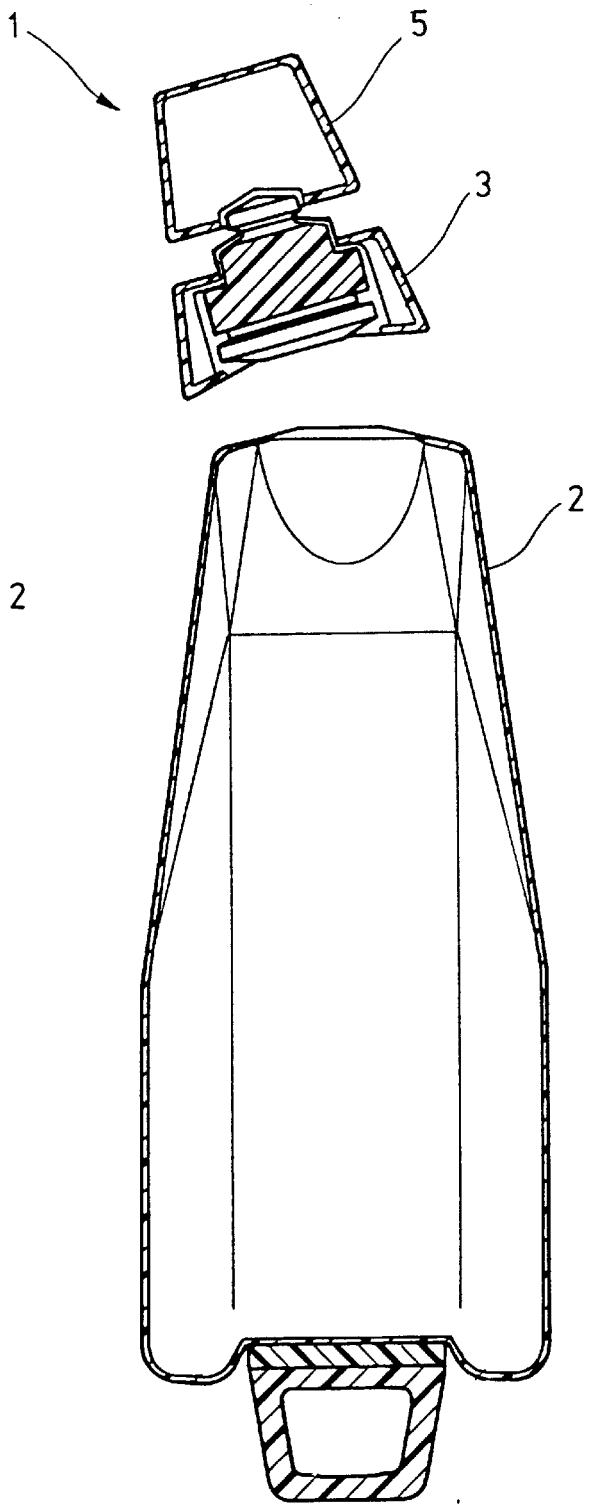
FIG. 4 is a front elevational view in section of the bottle of FIG. 1 with the neck separated at the second separation area.

To open bottle 1 at separation point 9, a tool can be inserted over the second toggle 13. With the aid of that tool, neck 3 can be twisted relative to bottle body 2 to cause breaking at separation point 9. Bottle 1 with a broken separation point 9 is shown in FIG. 4.

Bottle 1 can also be configured in the area of separation point 9 so that separation point 9 can be opened by hand without a tool. For example, a smaller interior diameter can be provided at separation point 9.

A plug 15 is inserted in neck 3, seals neck 3 mechanically and, at the same time, holds the liquid inside bottle body 2 antiseptically. Plug 15 is preferably manufactured of an elastomer and can be pierced by the needle of a syringe or an infusion set.

Figure 5:
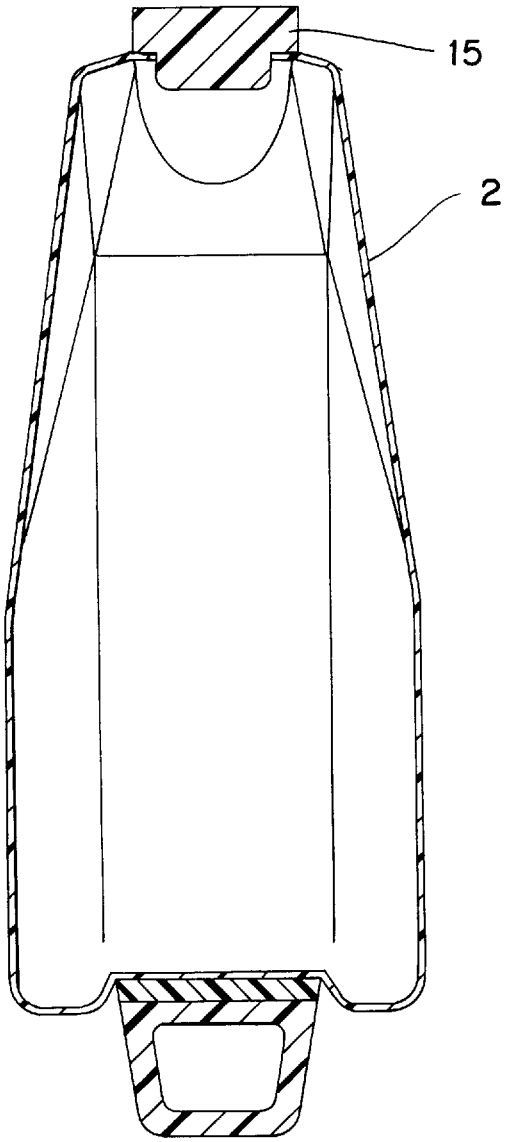
FIG. 5 is a front elevational view in section of the bottle of FIG. 1 with the neck separated at the second area and the plug removed from the neck and used to reclose the bottle.

After the neck is removed by opening bottle 1 at separation point 9, plug 15 can be removed from the separated neck in any suitable manner. Once the plug is free of the neck, it can seal the opening in the bottle as illustrated in FIG. 5.

At its opposite end from neck 3, bottle body 2 has a bottom 17. A lashing member 19 is formed on bottom 17. Lashing member 19 permits bottle 1 to be suspended for infusion applications. Bottom 17 of bottle body 2 is configured so that following removal of lashing member 19, by bending or breaking, bottle 1 can be placed in a stable manner with bottom 17 on a flat surface.

The outside of bottle body 2 can be provided with a series of measuring lines forming a scale for determination of the liquid volume in bottle 1. Preferably, two separate scales are applied. One scale would be used when bottle 1 is standing on bottom 17. The other scale would be used when the bottle is suspended by lashing member 19.

A blow molding method or suction molding method is used for manufacturing the bottle. In either case, bottle body 2 with bottom 17 and lashing 19, as well as the part of neck 3 incorporating the additional separation point 9 are formed from an extruded plastic hose. The liquid is then filled into bottle body 2. After the appropriate amount of liquid is received in the bottle body, plug 15 is inserted into neck 3. Finally, the rest of neck 3 and head 5 are shaped and formed with construction of the separation point 7, whereupon bottle 1 is sealed closed.

While various embodiments have been chosen to illustrate the invention, it will be understood by those skilled in the art that various changes and modifications can be made therein without departing from the scope of the invention as defined in the appended claims.

What is claimed is:

1. A plastic bottle, comprising:

a bottle body;

a neck on said bottle body;

a head on said neck;

a first separation area between and connecting said head and said neck;

a second separation area between and connecting said neck and said bottle body; and an elastomeric plug located within said neck between said first separation area and said second separation area and sealing said neck, and surrounded by a part of said neck.

2. A plastic bottle according to claim 1 wherein said first and second separation areas have different interior diameters.

3. A plastic bottle according to claim 1 wherein said separation areas comprise bottle wall sections of reduced wall thicknesses.

4. A plastic bottle according to claim 3 wherein one of said separation areas has means adjacent thereto for breaking said one separation area manually.

5. A plastic bottle according to claim 4 wherein the other of said separation areas has means adjacent thereto for applying a tool to break said other separation area with the tool.

6. A plastic bottle according to claim 3 wherein one of said separation areas has means adjacent thereto for applying a tool to break said one separation area with a tool.

7. A plastic bottle according to claim 1 wherein said plug is pierceable by a needle.

8. A plastic bottle according to claim 1 wherein said plug seals an internal chamber of said body.

9. A plastic bottle according to claim 1 wherein said plug has means for resealing said body at said second separation area after removal of said neck from said body and after removal of said plug from said neck.

10. A plastic bottle, comprising:

a bottle body;

a neck unitarily formed on said bottle body and connected to said bottle body through a first separation area, said neck having a neck opening remote from said body;

a head unitarily formed on said neck to close said neck opening and connected to said neck through a second separation area adjacent said neck opening;

an internal chamber in said bottle body for housing contents, said chamber terminating in a dispensing opening adjacent said first separation area;

a dispensing passageway extending through said neck between said dispensing opening of said internal chamber and said neck opening; and an elastomeric plug located within said neck between said first separation area and said second separation area and sealing said dispensing passageway;

whereby separation of said head from said neck at said second separation area exposes said plug through said neck opening allowing dispensing of the contents through a needle piercing said plug, and separation of said neck from said body at said first separation area removes said plug and exposes said dispensing opening allowing dispensing of the contents directly therethrough.

11. A plastic bottle according to claim 10 wherein a lashing member is coupled to an end of said bottle body remote from said neck.

12. A plastic bottle according to claim 10 wherein said first and second separation areas have different interior diameters.

13. A plastic bottle according to claim 10 wherein said separation areas comprise bottle wall sections of reduced wall thicknesses.

14. A plastic bottle according to claim 13 wherein one of said separation areas has means adjacent thereto for breaking said one separation area manually.

15. A plastic bottle according to claim 14 wherein the other of said separation areas has means adjacent thereto for applying a tool to break said other separation area with the tool.

16. A plastic bottle according to claim 13 wherein one of said separation areas has means adjacent thereto for applying a tool to break said one separation area with a tool.

17. A plastic bottle according to claim 10 wherein said plug comprises an end portion configured to fit within and seal said dispensing opening after the separation of said neck from said body and after removal of said plug from said neck.

18. A plastic bottle according to claim 10 wherein said plug is entirely located between said separation areas.

* * * * *